United States Patent [19]

Seymour et al.

[11] 4,339,642

[45] Jul. 13, 1982

[54] CURRENT SWITCHING MEMBER FOR CIRCUIT BREAKERS

[75] Inventors: Raymond K. Seymour, Plainville; Frank H. Murphy; Lelio C. Vergnano, both of West Hartford, all of Conn.

[73] Assignee: General Electric Company, New York, N.Y.

[21] Appl. No.: 225,951

[22] Filed: Jan. 19, 1981

[51] Int. Cl.[3] ..... H01H 1/22

[52] U.S. Cl. ..... 200/153 G; 200/244; 335/196

[58] Field of Search ..... 335/196; 200/153 G, 200/239, 244, 246, 267, 268

[56] References Cited

U.S. PATENT DOCUMENTS

| | | | |
|---|---|---|---|
| 1,724,840 | 8/1929 | Jones et al. | 335/196 |
| 2,492,762 | 12/1949 | Palme | 200/153 G |
| 2,506,792 | 5/1950 | Juhasz | 335/196 |
| 3,564,184 | 2/1971 | Gauthier | 200/244 |
| 3,930,211 | 12/1975 | Belttary | 200/246 |

*Primary Examiner*—John W. Shepperd

*Attorney, Agent, or Firm*—Richard A. Menelly; Walter C. Bernkopf; Fred Jacob

[57] ABSTRACT

The movable arm of a circuit breaker provides at its lower extremity a backing surface against which a copper carrier is clipped. A movable contact is affixed to the exposed surface of the carrier beyond the backing surface, such that current flow between the contact and a flexible, conductive braid, also affixed to the carrier, is conducted through the carrier rather than the arm which may then be fashioned from a less expensive, relatively low conductivity material such as steel.

6 Claims, 5 Drawing Figures

CURRENT SWITCHING MEMBER FOR CIRCUIT BREAKERS

BACKGROUND OF THE INVENTION

The present invention relates to residential electric circuit breakers and particularly to a cost improved current switching member therefor.

Traditionally, the elongated, pivotal current switching arm of an automatic electric circuit breaker has been formed of copper since it is included in the breaker internal circuit, in that it provides the current path between a movable contact affixed to its lower end and a flexible, conductive braid having one end affixed to the arm at a point intermediate its ends. The other end of the braid as affixed in electrical connection with overcurrent responsive breaker tripping means, typically a bimetal and an electromagnet, through which current flows enroute to the breaker load terminal. Completing the breaker internal circuit, the line terminal of the circuit breaker is electrically connected with a stationary contact which is engaged by the movable contact when the pivotal arm is manually operated to its closed circuit position via a spring-powered, typically toggle-type operating mechanism.

Since residential electric circuit breakers are enclosed in a molded, insulative case, high electrical conductivity of the current carrying movable contact arm is an absolute necessity in order to minimize watts loss. The heat developed within the molded case due to excessive voltage drop across the breaker internal circuit has a deleterious affect on the breaker parts, as well as upsetting the calibrated thermal trip setting.

In addition to high electrical conductivity, high thermal conductivity for the movable contact arm is also an important consideration. Since a significant source of heat is the voltage drop across the engaged stationary and movable contacts, it is important from the standpoint of long service life that they be adequately heat sinked such that heat be efficiently drawn away. This is especially so when a circuit breaker is utilized in switching duty applications, since the contacts are repeatedly being subjected to arcing. Insofar as the movable contact is concerned, the only available, effective heat sink is the arm.

It would be manifestly desirable to remove the circuit breaker movable arm from the breaker internal circuit and thus permit its fabrication from a material less expensive than copper. Achieving this would also avoid the significant material cost involved in the current practice of silver or tin plating the copper arm to discourage oxidation and corrosion. An approach to this end is disclosed in U.S. Pat. No. 3,930,211, wherein the movable contact is brazed to the end of a steel pivotal arm, and the braid is welded in direct electrical connection with the back side of the movable contact. While this design removes the arm from the breaker internal circuit, it is not seen that adequate heat sinking of the movable contact is provided, particularly when the circuit breaker is subjected to switching duty applications.

It is accordingly an object of the present invention to provide a cost improved current switching member for electric circuit breakers.

A further object is to provide a current switching member of the above character which provides a high electrical conductivity segment of the circuit breaker internal circuit.

Another object is to provide a current switching member of the above character which provides effective heat sinking of the movable contact supported thereby.

Yet another object is to provide a current switching member of the above character which is convenient to assemble and both efficient and reliable in service.

Other objects of the present invention will in part be obvious and in part appear hereinafter.

SUMMARY OF THE INVENTION

In accordance with the present invention, there is provided a current switching member for electric circuit breakers having significantly reduced material costs. To this end, the switching member includes an elongated arm mounted for pivotal movement by a spring powered operating mechanism between open and closed circuit positions. Heretofore, this arm has been fabricated of copper since it has traditionally constituted a portion of the circuit breaker internal circuit; being called upon to conduct current flowing between a movable contact affixed to its free lower end and a copper braid affixed to the arm at a point intermediate its ends. Pursuant to the present invention, this movable arm is fabricated of a material less expensive than copper, preferably steel. To overcome the problems engendered by the lower electrical and thermal conductivity of steel versus copper, a carrier, formed of copper, is mounted to the lower extremity of the arm. The movable contact and braid are affixed in electrical connection with the carrier, which then becomes a current carrying part of the breaker internal circuit rather than the arm. The carrier, though smaller in size than the arm to effect significant material cost savings, is nevertheless of sufficient mass to provide an effective heat sink for the movable contact.

As a feature of the present invention, the carrier is simply, in effect, clipped to the arm lower extremity, thus avoiding the problems involved in bonding together copper and steel parts, such as by brazing. To this end, the lower extremity of the arm is configured to provide a backing surface, and the carrier is provided with a body conforming to this backing surface. A tang integrally formed with the carrier body is clenched to the arm extremity to clamp the carrier body against the backing surface. Cooperating with the tang, is a tab projecting from the arm and protruding through a slot in the carrier to positively capture the carrier to the arm lower extremity. The movable contact is brazed to the exposed surface of the carrier body opposite the backing surface, and thus its electrical contacting engagement with the stationary contact is firmly backed by the arm lower extremity.

The invention accordingly comprises the features of construction and arrangement of parts which will be exemplified in the construction hereinafter set forth, and the scope of the invention will be indicated in the claims.

For a better understanding of the nature and objects of the invention, reference should be had to the following detailed description taken in conjunction with the accompanying drawings in which:

DESCRIPTION OF THE DRAWINGS

Corresponding reference numerals refer to like parts throughout the several views of the drawings.

DETAILED DESCRIPTION

Figure 1:
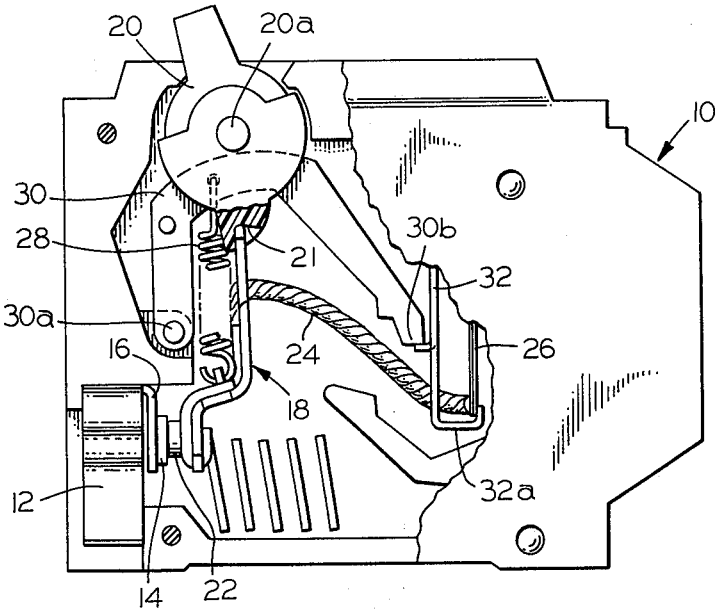
FIG. 1 is a side elevational view, partially broken away, of a molded case, residential circuit breaker to which the present invention is adapted.

Referring to FIG. 1, the present invention is shown incorporated in an electric circuit breaker of the type disclosed in U.S. Pat. No. 3,268,689, having a molded insulative case 10. Fixedly disposed within this case is a line terminal stab 12 and a stationary contact 14 supported by an electrically interconnecting line strap 16. The current switching member of the present invention, generally indicated at 18, is pivotally supported at its upper end by an insulating handle 20 pivotally mounted at 20*a* by molded case 10. The lower end of the switching member carries a movable contact 22 which engages the stationary contact when the switching member assumes its closed circuit position seen in FIG. 1. From the switching member, current is conducted by a flexible braid 24 to the lower free end of an elongated bimetal 26. The upper, mounted end of the bimetal is electrically connected via a load strap to a load terminal (not shown), thus completing the circuit breaker internal circuit.

Manual operation of the circuit breaker between its OFF and ON conditions is effected by handle 20, which functions with switching member 18 as a toggle whose knee is their pivotal interconnection indicated at 21. A tension spring 28 is hooked at its lower end to the switching member and at its upper end to a trigger 30, which is pivotally mounted within case 10 at its extreme left end, indicated at 30*a*. The extreme right end 30*b* of the trigger is engaged by a pivotal latch 32 such as to releaseably sustain the trigger in its reset position shown. Under these circumstances, it is seen that, with handle 20 in its illustrated counterclockwise-most ON position, the line of action of spring 28 is to the left of the toggle knee 21, and, consequently, switching member 18 is biased in the clockwise direction to its illustrated closed circuit position. As the handle is pivoted in the clockwise direction to its OFF position, the toggle knee is swung leftward through the line of action of the spring, whereupon the current switching member becomes biased in the counterclockwise direction. The switching member then springs to its open circuit position (not shown), separating the breaker contacts in quick-break fashion. When the handle is returned to its ON position, the toggle knee is swung back through the spring line of action, and the switching member springs to its closed circuit position in quick-make fashion.

Tripping of the circuit breaker to automatically separate the breaker contacts in response to an overcurrent position is effected by swinging latch 32 rightward to release trigger 30 from its reset position. Such release is prompted by bimetal 26 deflecting to the right in response to a prolonged overload current condition; such rightward movement being communicated to the latch by virtue of a hook extension 32*a* thereof. As seen in the above-noted U.S. Pat. No. 3,268,689, the circuit breaker is typically equipped with an electromagnet effective in attracting latch 32 as an armature to the right in response to a heavy overload or short circuit condition and thereby release trigger 30 from its reset position. In either case, the released trigger is pivoted clockwise by spring 28, swinging the spring line of action from left to right through toggle knee 21. The spring then acts to bias switching member 18 in the counterclockwise direction to an open circuit position and the handle to an intermediate trip indicating position. The trigger is returned to its latched, reset position by manipulation of the handle to its clockwisemost OFF position, whereupon the breaker may then be reclosed by pivoting the handle to its ON position.

The current switching member 18 of the present invention will now be described in detail in conjunction with FIGS. 2 through 5. Thus, the switch member includes an elongated arm 36 which, in the illustrated embodiment, is bifurcated to provide a pair of spaced, parallel legs 36*a* upstanding from a contoured, lower extremity body 36*b*. It will be appreciated that the arm need not be bifurcated for purposes of the invention. As a feature of the invention, the arm is formed from a structurally rigid material less expensive than copper heretofore utilized to provide the requisite high electrical and thermal conductivity. Preferably, the arm is formed from sheet steel stock. The free ends of the legs are provided with laterally extending ears 38 which are held engaged in separate notches formed in a depending portion of handle 20 by spring 28 to constitute toggle knee 21 (FIG. 1). The arm body 36*b* is tapered down to a rather blunt termination which is edge notched, as indicated at 40. Lanced from the upper edge of the arm body between legs 36*a* is an upstanding tab 42 in which is formed a small hole 42*a*.

To restore the requisite high electrical conductivity lost by fabricating arm 36 of steel, switching member 18 utilizes a carrier 44 formed of copper sheet stock having a body 44*a* contoured in conformation with body 36*b* of the arm. Integrally formed in depending relation with the lower edge of the carrier body is a tang 44*b*. An extension 44*c* upstanding from one upper corner of the body serves as a connector pad to which one end of braid 24 is affixed in electrical connection with the carrier by suitable means, such as brazing. Affixed to the lower surface portion of body 44*a* in electrical connection with the carrier is movable contact 22. A transversely elongated slot 44*d* is formed in the carrier adjacent the upper edge of its body 44*a*.

Figure 3:
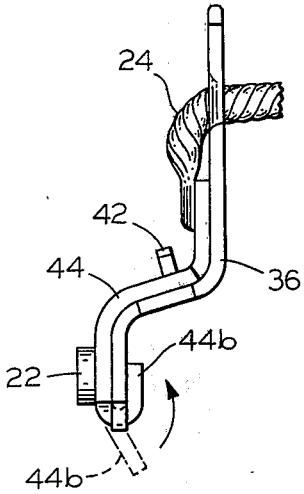
FIG. 3 is a side elevational view of the assembled current switching member of FIG. 2.
Figure 2:
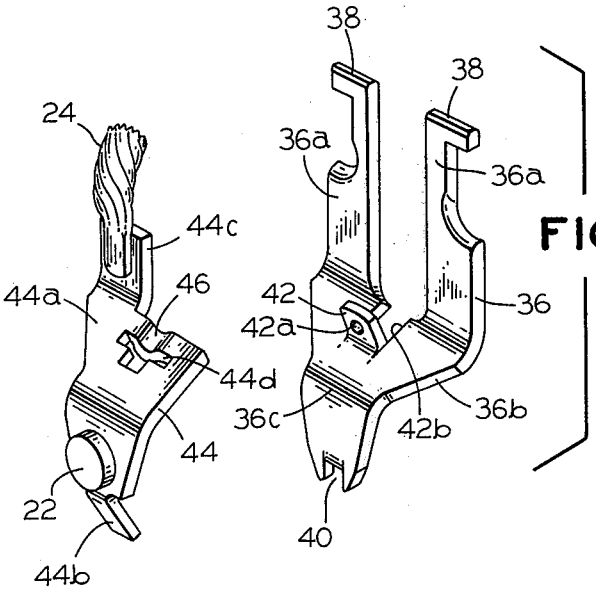
FIG. 2 is a perspective assembly view of the current switching member of the invention as utilized in the circuit breaker of FIG. 1.
Figure 4:
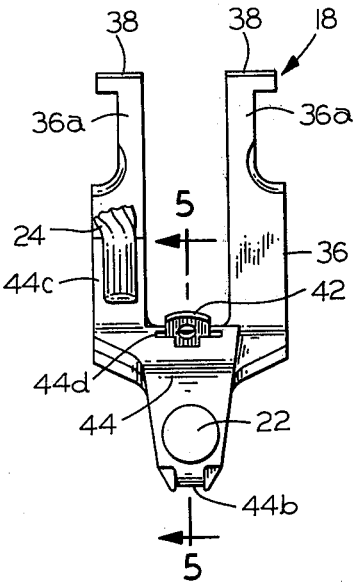
FIG. 4 is a front view of the assembled current switching member of FIG. 2.
Figure 5:
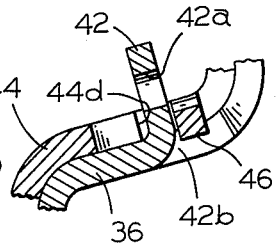
FIG. 5 is a sectional view taken along line 5—5 of FIG. 4.

To assemble copper carrier 44 to steel arm 36, tab 42 of the arm is inserted through slot 44*d* of the carrier to seat the carrier body against a conforming backing surface 36*c* of the arm lower extremity body. Tang 44*b* is then bent back and around into clenching engagement with the arm body, as seen in FIG. 3. The clenching of this tang together with the engagement of tab 42 in slot 44*d* serve to positively capture the carrier to the arm with the movable contact in position to engage the stationary contact when the switching member assumes its closed circuit position of FIG. 1. Tab 42 also serves, by virtue of hole 42*a* therein, as the anchor for the lower hooked end of tension spring 28. In this connection, slot 44*d* is preferably made T-shaped, as illustrated, and the portion of the carrier body between its upper edge and the slot is bumped downward, as indicated at 46, to provide adequate clearance facilitating the insertion of the hooked spring end through hole 42*a*. Lateral mounting stability for the carrier is afforded by virtue of the provision of notch 40 through which the clenched tang 44*b* extends in close-fitting relation. Furthermore, bumped down segment 46 conveniently protrudes into slot 42*b* left by the lancing of tab 42 to further discourage lateral movement of the carrier relative to the arm. This compensates for the preferred lengthening of slot 44*d* relative to the width of tab 42 to facilitate automated assembly.

From the foregoing description, it is seen that copper carrier 44 provides a high conductivity, direct current path between the movable contact and the braid in a circuit breaker internal circuit, and thus arm 36 may be fabricated of steel rather than copper. Since the carrier is of considerably smaller size than the arm, significant material cost savings are realized. By the same token, if the practice of plating current carrying parts is followed, less plating metal, whether it be silver or tin, is required for further cost savings. While the carrier is of smaller size than the arm, its thermal mass can be made sufficient to adequately heat sink the movable contact and still achieve the noted cost savings objective. In this connection, by conforming the carrier to the configuration of the arm lower extremity body, an intimate intersurface relationship is created, and thus effective thermal coupling is achieved to enable the arm to draw heat out and away from the carrier. Moreover, this intimate intersurface relationship affords firm backing for the movable contact as it is pressed into reliable, electrical engaging relation with the stationary contact under the bias of the breaker mechanism spring. The simple and yet eminently effective manner of mechanically mounting the carrier to the arm, as taught by the present invention, is seen to avoid the problems involved in uniting copper and steel parts.

It will thus be seen that the objects set forth above, among those made apparent in the preceding description, are efficiently attained and, since certain changes may be made in the above construction without departing from the scope of the invention, it is intended that all matter contained in the above description or shown in the accompanying drawings shall be interpreted as illustrative and not in a limiting sense.

Having described our invention, what we claim as new and desire to secure by Letters Patent is:

1. In an electric circuit breaker having a spring-power toggle-type operating mechanism, an improved current switching member comprising, in combination:

A. an elongated steel arm including
  (1) an upper end portion accommodating pivotal connection with a circuit breaker operating handle,
  (2) means on said arm intermediate its ends to anchor the hooked one end of a circuit breaker operating mechanism tension spring, and
  (3) a lower extremity portion providing a backing surface;

B. a copper carrier including
  (1) a body, and
  (2) means capturing said carrier to said arm with a first surface of said body in intimate relation with said backing surface, said means including a tang extending from said body and clenched in engaging relation with said arm lower extremity portion;

C. an electrically conductive braid having one end affixed in electrical connection with said carrier; and D. a circuit breaker movable contact affixed to a second surface of said body opposed from said first surface in electrical connection with said carrier.

2. The current switching member defined in claim 1, wherein said capturing means further includes a tab projecting from said arm and means forming a slot in said carrier body at a location remote from said tang, said tab being accommodated through said slot to cooperate with said clenched tang in capturing said carrier to said arm.

3. The current switching member defined in claim 2, wherein said spring anchor means is in the form of a hole created in the free end portion of said tab projecting through said slot.

4. The current switching member defined in claim 2, wherein said arm further includes means forming a notch in the lower edge of said lower extremity portion, said clenched tang being accommodated in said notch.

5. The current switching member defined in claim 4, wherein said tab is lanced from said arm and said carrier body includes a bumped portion adjacent said slot, said bumped portion protruding into the gap in said arm created by the lancing of said tab.

6. The current switching member defined in claims 1, 2, 3, 4, or 5, wherein said arm is formed of steel.

* * * * *